US005095321A

United States Patent [19]

Saito et al.

[11] Patent Number: 5,095,321

[45] Date of Patent: Mar. 10, 1992

[54] LIQUID JET RECORDING HEAD JOINED BY A BIASING MEMBER

[75] Inventors: Akio Saito, Hadano; Makiko Kimura, Sagamihara; Tsutomu Abe, Isehara; Hiroshi Nakagomi, Yamato; Takashi Watanabe, Yokohama; Norihisa Saito, Tokyo; Kunihiko Maeoka, Kawasaki; Kazuaki Masuda, Sagamihara, all of Japan

[73] Assignee: Canon Kabushiki Kaisha, Tokyo, Japan

[21] Appl. No.: 429,050

[22] Filed: Oct. 30, 1989

[30] Foreign Application Priority Data

Oct. 31, 1988 [JP] Japan ..... 63-275793
Oct. 31, 1988 [JP] Japan ..... 63-275796
Oct. 31, 1988 [JP] Japan ..... 63-275798
Oct. 31, 1988 [JP] Japan ..... 63-275799

[51] Int. Cl.[5] ..... B41J 2/05; B41J 2/16

[52] U.S. Cl. ..... 346/140 R; 346/75

[58] Field of Search ..... 346/140, 75, 140 R

[56] References Cited

U.S. PATENT DOCUMENTS 4,257,052 3/1981 Stoneburner ..... 346/75
4,314,259 2/1982 Cairns ..... 346/75
4,450,455 5/1984 Sugitani ..... 346/140
4,528,575 7/1985 Matsuda et al. ..... 346/140 R
4,559,543 12/1985 Toganoh et al. ..... 346/140 R
4,678,529 7/1987 Drake et al. ..... 156/234
4,707,705 11/1987 Hara ..... 346/140
4,779,099 10/1988 Lewis ..... 346/140

FOREIGN PATENT DOCUMENTS 0063637 11/1982 European Pat. Off. .

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A liquid jet recording head comprises a first substrate provided with an energy-generating element that generates an energy for discharging a recording liquid, a second substrate joining to the first substrate, the second substrate having grooves that form passages for the recording liquid in accordance to the position of the energy-generating element at the joining and being integrated with a discharge port-forming member that forms discharge ports for the recording liquid on the front side of the grooves, and a force-endowing member that tightly fixes the first and second substrates to each other by a mechanically endowed force. The head has a high reliability and can be produced in a high productivity at a low cost with a smaller number of production steps.

30 Claims, 8 Drawing Sheets

LIQUID JET RECORDING HEAD JOINED BY A BIASING MEMBER

BRIEF DESCRIPTION OF THE INVENTION

1. Field of the Invention

This invention relates to a liquid jet recording head and an apparatus for liquid jet recording provided with the head, and more particularly to a liquid jet recording head for use in an apparatus for liquid jet recording where the recording is carried out with liquid droplets discharged from discharge ports and an apparatus for liquid jet recording provided with the head.

2. Related Background Art

Heretofore, various apparatuses for liquid jet recording have been proposed. They include those based on the deformation of a piezoelectric element to generate a pressure change in the liquid passage, thereby discharging fine liquid droplets, those based on provision of a pair of electrodes to change the moving direction of fine liquid droplets, or those based on abrupt heat generation of a provided heat-generating element to generate bubbles and discharge the liquid droplets from the discharge ports by virtue of the heat energy.

Above all, a liquid jet recording head which utilizes a heat energy to discharge a recording liquid can make recording with a high resolving power and can be made more compact on the whole as a recording head, because liquid discharge ports for discharging liquid recording droplets to form flying liquid droplets such as orifices, etc., which may be hereinafter referred to as "orifices", can be arranged at a high density. Furthermore, such a head can fully utilize the advantages of IC technology and microprocessing technology that recently enjoy a remarkable technical progress and a considerable improvement in reliability in the semiconductor field and also can be readily made longer in the size or two-dimensionally flatter, resulting in easier formation of multinozzle at a higher density and higher productivity in the mass-production at a lower production cost.

FIGS. 1A and 1B show one embodiment of such a liquid jet recording head of the prior art. In FIGS. 1A and 1B, numeral 1 is a first substrate made of Si, etc., and a group of electro-thermal converters as discharge energy-generating elements and their wirings are provided on the upper surface of the first substrate 1. Numeral 8 is a second substrate made of glass, metal, etc., and an inlet 9 for a recording liquid such as ink, etc., which will be hereinafter referred to merely as ink, grooves 11A which form ink passages 11A corresponding to the electro-thermal converters, ink passage walls 10 and a recess 12 as a common liquid chamber which stores the introduced ink and distributes the ink to each of the passages are provided on the second substrate 8 by cutting, etching, etc.

As shown in FIG. 1A, the first and second substrates are fixed to each other by jointing with an adhesive 13 to provide a recording head as shown in FIG. 1B.

However, the head of the afore-mentioned structure has such a disadvantage as a possibility to deteriorate the straight movement of ink droplets when discharged. This is particularly due to use of different materials in the formation of head orifices and the consequent difference in the wettability to the ink at the orifice peripheries. In order to overcome the disadvantage, it has been so far proposed to form an ink jet by separately preparing an orifice plate, that is, a metal plate or a photosensitive glass plate provided with orifices by etching, and pasting the orifice plate onto the head body. However, a liquid jet recording head of such a structure, which may be hereinafter referred to as an ink jet recording head or merely as a recording head, has the following problems.

First of all, in order to fix the first and second substrates 1 and 8 by bonding without any clearances therebetween and with a high liquid-tight sealing it is preferable to apply the adhesive 13 over the entire jointing surface of the second substrate 8. However, the pitches between passages 11 and the height of passage walls 10 are as small as about several 10 μm and the adhesive flows over to the passage sides owing to the pressure applied at the joint, unless the application amount of the adhesive 13 is controlled to a few μm in terms of the thickness, and consequently the passage size or discharge port size is fluctuated or the passages or discharge ports may be clogged. It has been contemplated to apply the adhesive only to the peripheral parts along the three peripheral sides of the second substrate and/or the first substrate, but it has been found difficult to joint the second substrate to the first substrate without any clearances owing to the deviation from the flatness, uneven surfaces, and fluctuation in the flatness during the production of these two substrates.

Furthermore, deformation or warping occurs, depending on substrate materials, for example, when the second substrate 8 is made from a resin material, and this seems to be the main factor of towering the tight sealing between the passage walls 10 and the first substrate 1.

In the afore-mentioned prior art, not only is an adhesive application step required, but also strict positioning is required for the jointing. Furthermore, jointing often cannot be carried out repeatedly so long as an adhesive is used, and thus the production steps are complicated and much labor is required for the production. It is also difficult to increase the product yield.

Still furthermore, a step of jointing an orifice plate is included in the production of the above-mentioned ink jet recording head, and it is necessary to make strict positioning of the orifice and the passages at the jointing. When the end surfaces of the first and second substrates, to which the orifice plate is to be jointed, are not at the same plane, a difficulty arises at the jointing of these two substrates.

The orifice plate is fixed with an adhesive, and thus the same problems as mentioned above in reference to the use of an adhesive may be encountered. When the adhesion is not enough, there is a fear of peeling of the orifice plate.

The afore-mentioned complicatedness and large number of the production steps are a cause for an increase in the production cost of recording heads, and this has been a problem in making disposable-type recording heads of the foregoing structure or of a structure integrated with an ink tank as an ink supply source, etc.

As already mentioned above, the ink jet recording head generally has ink discharge ports (orifices), ink passages and discharge energy-generating elements provided at some of the ink passages.

According to a known method for producing such ink jet recording heads as above, fine recesses, which will be hereinafter referred to as grooves, are formed on a substrate of, for example, glass, metal, etc. by cutting or etching, as already mentioned above, and then the substrate with the grooves is bonded to another appropriate substrate to form ink passages in the head.

In the case of a plurality of ink passages, the ink passages are mostly communicated with a common liquid chamber to smoothly and fully supply a recording liquid into the ink passages.

In order to supply a sufficient amount of a recording liquid to the ink passages in accordance to the amount consumed by the ink discharge, a common liquid chamber with a volume large enough to meet the consumed amount is desirable. However, in the common liquid chamber having a substantially same height as those of the ink passages, the flow resistance of the recording liquid cannot be substantially reduced and sometimes the recording liquid cannot be supplied sufficiently, though the common liquid chamber has an enough volume. Consequently, it is an ordinary structural practice to make the height of the common liquid chamber throughly larger than the heights of the liquid passages. However, it is difficult in the method for forming five grooves in a substrate of glass or metal to make a common liquid chamber having a sufficient height in comparison with the heights of the ink passages.

Furthermore, it is possible to repeat etching a plurality of times to increase the etching rate of a common liquid chamber, thereby increasing the height of the common liquid chamber, but this procedure cannot meet the requirements for lower cost and higher productivity owing to the increased number of production steps. Thus, it is an ordinary practice to separately prepare a common liquid chamber part and joint the common liquid chamber part to the end of the ink passage part by an adhesive, etc., thereby forming a desired common liquid chamber. This procedure is preferable in the performance of ink jet head, because a sufficient volume can be given to the common liquid chamber. However, the procedure for jointing a separately prepared part has inherent problems of increasing the number of the production steps and lowering the productivity and thus still has the problems to be solved for more cost reduction.

In these procedures, there sometimes take place stress development and improper positioning due to the curing contraction of adhesive, leakage of recording liquid due to an incomplete liquid tightness, flowing of an adhesive over into the ink passages or common liquid chamber or clogging.

SUMMARY OF THE INVENTION

An object of the present invention is to solve the afore-mentioned problems and provide an ink jet recording head of high reliability at a low cost, whose production steps are simpler and number of whose production steps is smaller.

Another object of the present invention is to solve the various problems as mentioned above and provide an ink jet recording head, where the common liquid chamber and ink passages are integrated.

Other object of the present invention is to provide a liquid jet recording head, which comprises a first substrate provided with an energy-generating element that generates an energy for discharging a recording liquid, a second substrate jointed to the first substrate, the second substrate having grooves that form passages for the recording liquid in accordance to the position of the energy-generating element at the jointing and being integrated with a discharge port-forming member that forms discharge ports for the recording liquid on the front side of the grooves, and a force-endowing member that tightly fixes the first and second substrates to each other by a mechanically endowed force.

Further object of the present invention is to provide a liquid jet recording head, which comprises a first substrate and a second substrate, both capable of forming passages for a recording liquid by jointing of the first and second substrates, and a force-endowing member giving a force to the first and second substrates from the opposite sides to the jointing surfaces, thereby tightly fixing, the first and second substrates.

Still further object of the present invention is to provide a liquid jet recording head, which comprises a first substrate provided with an energy-generating element for generating an energy for discharging a recording liquid, and a second substrate jointed to the first substrate, the second substrate having grooves that form passages for the second liquid at the jointing and being integrated with a discharge port-forming member that forms discharge ports on the front side of the grooves.

Still further object of the present invention is to provide a liquid jet recording head, which comprises a top plate provided with a plurality of passages each corresponding to a plurality of discharge ports and a recess forming a common liquid chamber for storing a recording liquid to be supplied to the passages, and a substrate having an energy-generating element for generating an energy for discharging the recording liquid to be provided in some of the passages, the top plate and the substrate being jointed to each other, and the top plate being integrally formed by injection molding.

Still further object of the present invention is to provide an apparatus, which comprises one of the aforementioned liquid jet recording heads and a member for disposing the liquid jet recording head thereon.

In the present invention, a step of pasting a discharge port-forming member as an orifice plate is not necessitated in the production of recording heads and thus the positioning at the pasting is entirely unnecessitated. Furthermore, no adhesive is required at that part and the disadvantages of passage clogging, etc. due to the use of such an adhesive can be overcome. Still furthermore, the first and second substrates can be tightly fixed to each other by a force-endowing member such as a spring, etc., and thus the amount of an adhesive or a sealing agent to be applied to the jointing surfaces can be minimized and also the positioning of the first and second substrates can be facilitated at the jointing.

That is, in the present invention, the production of recording heads can be simplified on the whole.

Still furthermore, in the present invention, a top plate integrally provided with recesses (grooves) for ink passages with a fine shape and a common liquid chamber several ten times as large as the ink passages can be formed. By use of a resin as a material for the top plate, a high smoothness can be obtained in the ink passages.

DETAILED DESCRIPTION OF THE PREFERRED EMBODIMENTS

The present invention will be explained hereinunder with reference to the drawings.

Figure 2A:
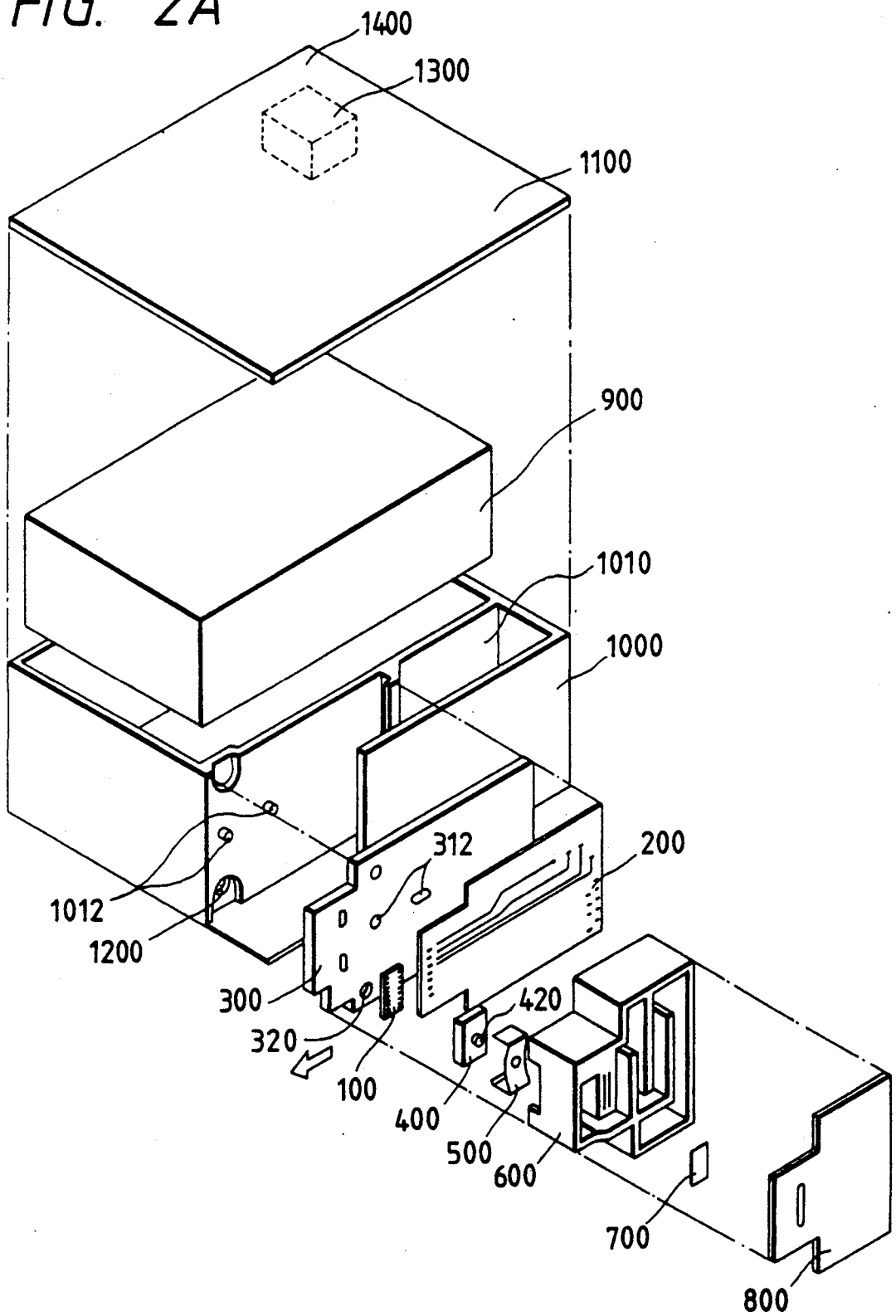
FIGS. 2A and 2B are a dismantled perspective view and a schematic outlook view, respectively, illustrating the structure of a cartridge including a recording head according to one embodiment of the present invention.
Figure 2B:
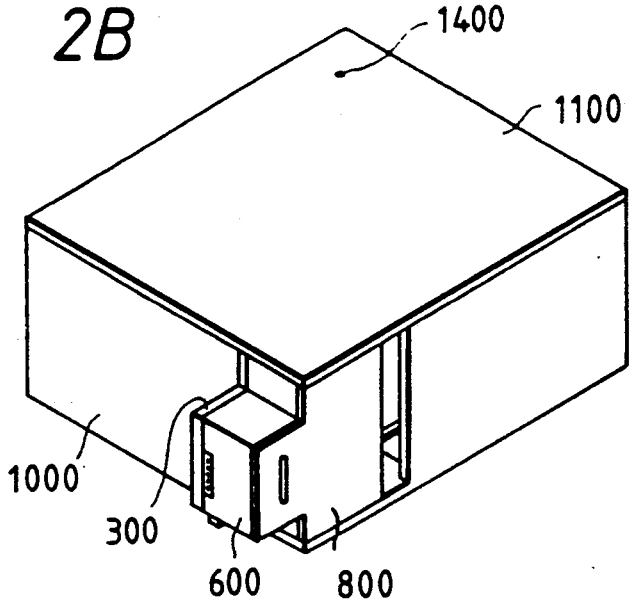

FIGS. 2A and 2B show an inkjet recording head of one embodiment of the present invention, which is a disposable type in which an ink accommodation part (an ink supply source) is integrated into a one piece.

Figure 1A:
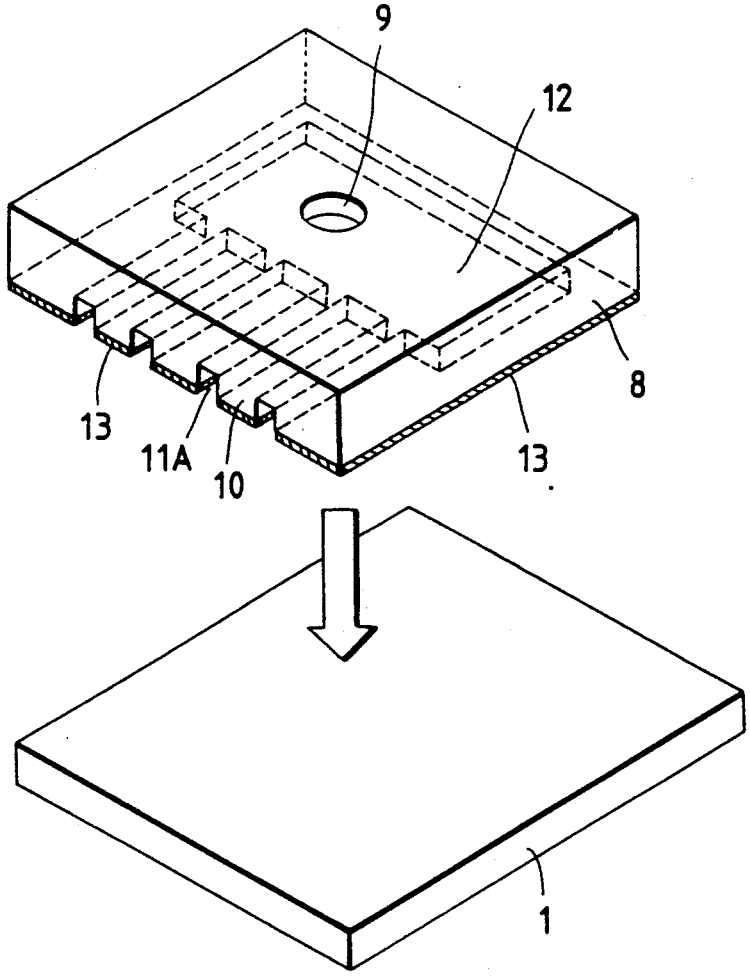
FIG. 1A PRIOR ART
FIGS. 1A and 1B are schematic views illustrating assembling of the prior art recording head.
Figure 1B:
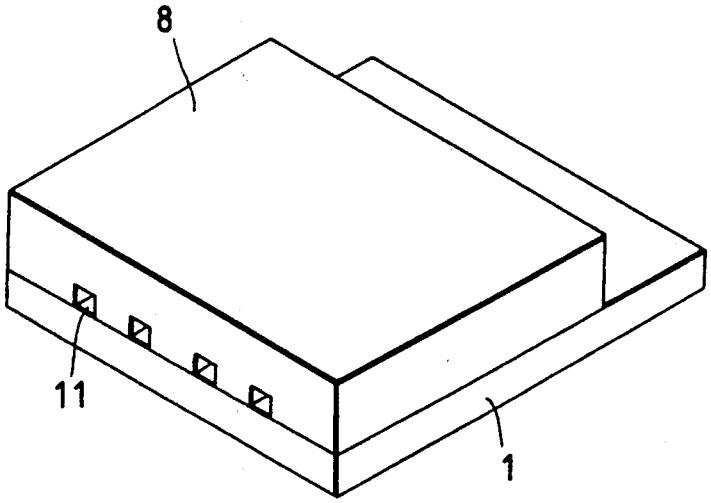
FIG. 1B PRIOR ART

In the FIG. 2A, 100 indicates a heater board comprising an electrothermal converter (discharge heater) and a wire, made of, for example Al, that supplies power to a converter which is formed on a Si substrate, and corresponds to the first substrate 1 in FIG. 1A and 1B. A detailed configuration for this is described in FIG. 3A and 3B. 200 is a wiring board for the heater board 100, and corresponding wiring is connected, for example, by wire bonding.

400 is a ceiling board in which a partition for limiting ink flow and a common liquid compartment are provided, and corresponds to the second substrate 8 in FIG. 1A and 1B. In this embodiment, the ceiling board 400 is made of a resin material having an orifice plate part integrally attached. The detailed configuration of the ceiling board 400 will be described in FIGS. 4 and 5.

300 is, for example, a metal support body, and 500 is a pressing spring. Both of them are engaged in the condition that the heater board 100 and the ceiling board 400 are sandwiched between them, and the heater board 100 and the ceiling board 400 are pressure-fixed by the biasing force of the pressing spring 500. This relationship is further described in FIGS. 9 and 10. A wiring board 200 is provided and is secured to the support body 300, and the support body may have a mounting standard for attaching a carriage for scanning the head. The support body 300 also functions as a member which discharges heat from the heater board 100 with the driving.

600 is a supply tank, which functions as a subtank that receives ink from the ink storage part which is an ink supply source, and further introduces the ink to the common liquid room formed by the junction of the heater board 100 and the ceiling board 400. 700 is a filter located in a position inside the supply tank 600 near the ink supply outlet to the common liquid room. 800 is a lid of the supply tank 600.

900 is an absorber for impregnating ink, and is placed inside the cartridge main body 1000. 1200 is a supply outlet for supplying ink to the unit formed by the above described parts 100 to 800. Ink impregnation can be made for the absorber 900 by injecting ink from the supply outlet 1200 in a process prior to the process of locating the unit within the compartment 1010 of the main body 1000 of the cartridge.

1100 is a lid member of the cartridge main body. 1400 is an air connecting outlet located in the lid member for connecting the inside of the cartridge to the atmosphere. 1300 is a liquid evaporating material placed inside the air connecting opening 1400, which prevents ink from leaking through the air connecting opening 1400.

When the filling of ink via a supply opening 1200 is complete, the unit comprising the parts 100 to 800 is positioned with respect to the compartment 1010 and mounted. The positioning and fixing of these components can be facilitated by engaging the projections 1012 disposed in the cartridge main body 1000 with the holes 312 that are correspondingly disposed in the support body 300. This completes the cartridge in FIG. 2A.

Ink is supplied to the supply tank 600 from the cartridge via the supply opening 1200, a hole 320 provided in the support body 300 and the inlet provided in the rear side in FIG. 2A of the supply tank 600. After passing through the inside of the supply tank, the ink flows into the common liquid compartment from the inlet via appropriate supply pipes and the ink inlet 420 of the ceiling board 400. In the connection part for supplying ink in the above, packings such as silicon rubber or butyl rubber are disposed, which seals ink and secures an ink supply passage.

Figure 3A:
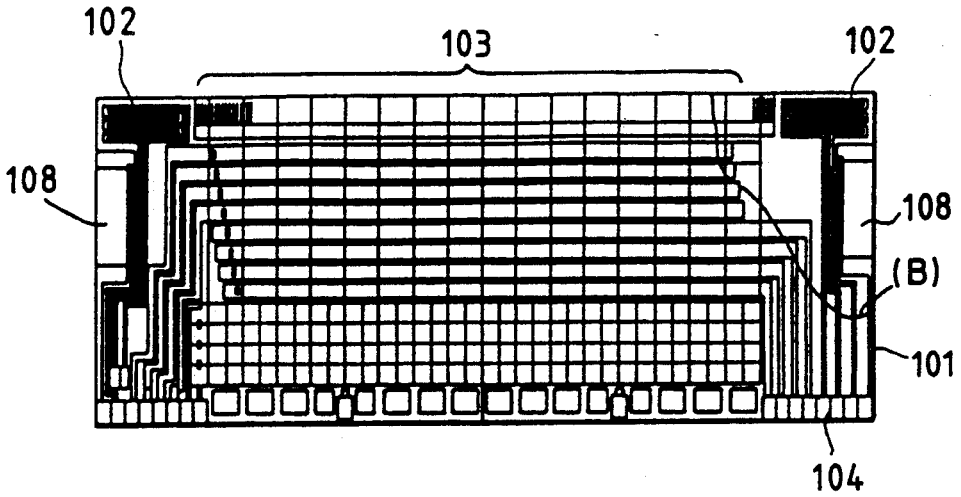
FIGS. 3A and 3B are a plan view and a partially enlarged view thereof, respectively, illustrating one embodiment of a heater board applicable to the recording head according to the present invention.
Figure 3B:
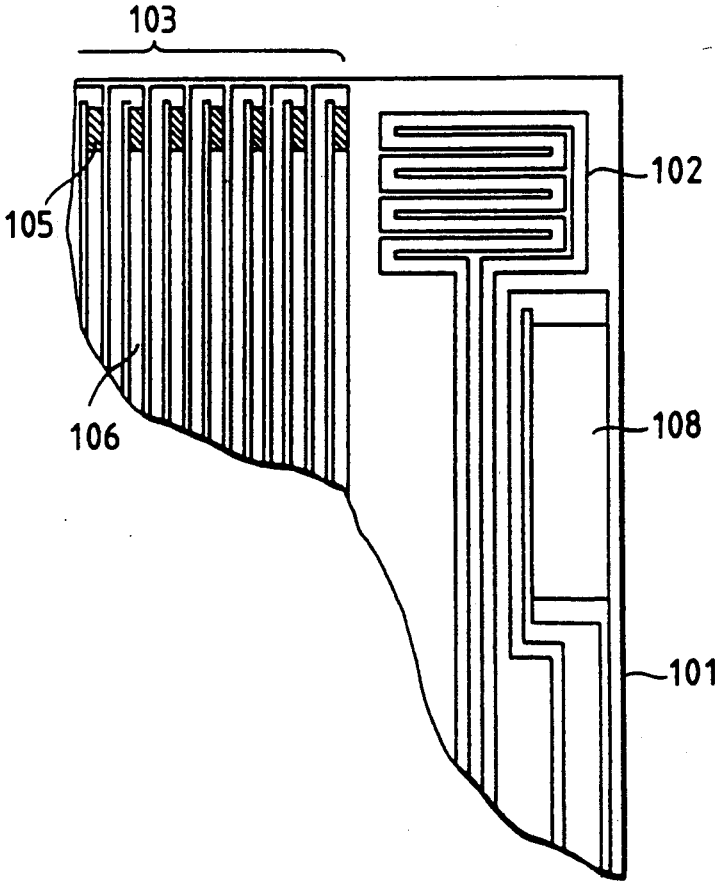

FIGS. 3A and 3B are a plan view and a partially enlarged view of the heat board 100 of the present embodiment.

In FIG. 3A, 101 is a heater board, and 103 is a discharge heater part of this embodiment. 102 is a temperature sensor, and is formed to the discharge heater part 103 by the same film-forming process as for the discharge heater part 103. FIG. 3B is an enlarged view of the part A including the sensor 102 in FIG. 3A. 105 and 106 are a discharge heater and wiring respectively. 108 is a temperature-keeping heater for heating the head.

Since the sensor 102 is formed by the film-forming process used for semiconductors in the same way as for the other parts, it is very accurate, and can be made from materials, such as aluminum, titanium, tantalum, tantalum pentoxide or niobium which is a component material for the other parts, which change their electric conductivity depending on the temperature. For example, among these materials, titanium is a material that can be disposed between the heating resistance layer and an electrode which form an electrothermal conversion element for the purpose of strengthening their contact. Tantalum is a material that can be disposed thereon for the purpose of increasing the anti-cavitation of the protective layer on the heating resistance layer. To decrease the variations of the process, the larger gauge of the wire is employed. To reduce the influence of wiring resistance, its shape is made zigzag to increase the resistance.

The temperature-keeping heater 108 can be likewise formed by using the same material (e.g., $HfB_2$) as the heating resistance layer of the discharge heater 105. It may also be formed by using other materials forming the heater board, for example, aluminum, tantalum, titanium.

Figure 4:
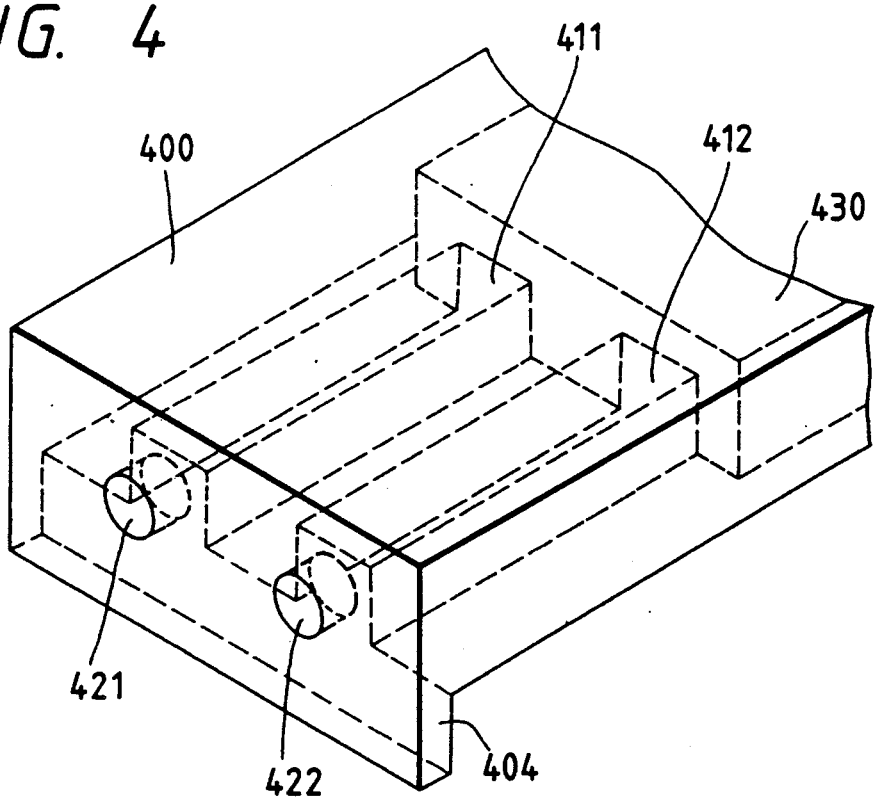
FIGS. 4 and 5 are schematic views showing two examples of a top plate to be jointed to the heater board of FIG. 3 according to the present invention.
Figure 5:
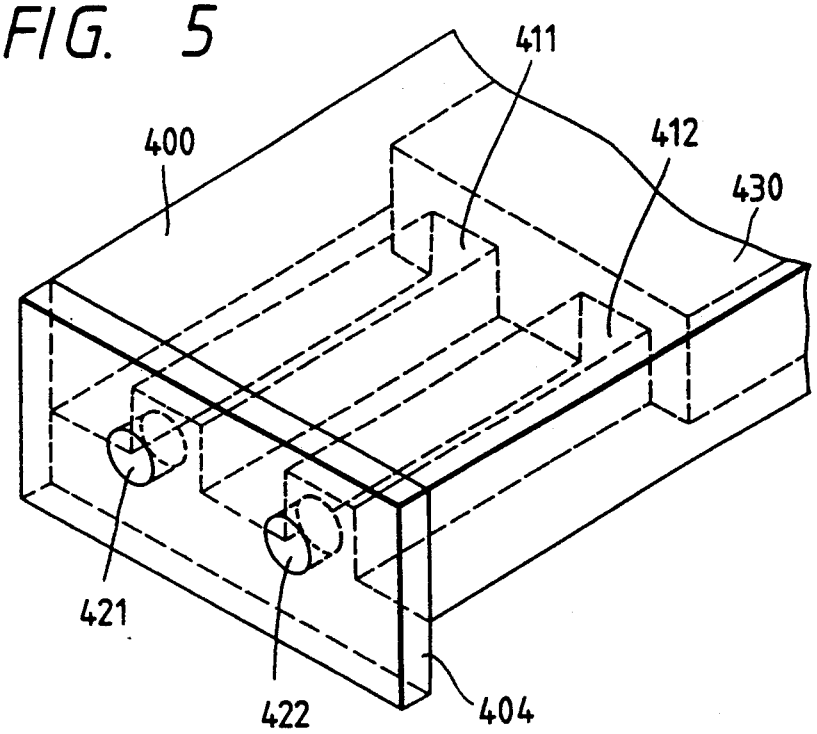

FIGS. 4 and 5 show the two examples of the configuration of the ceiling board 400 of the present invention.

The ceiling board 400 of the present invention has a desired number (for simplification only two are shown) of ink passage grooves 411, 412 and ink discharge ports or outlets (orifice) 421, 422, formed in an orifice plate part 404 in correspondence with the ink passage grooves.

In the example of the configuration shown in FIG. 4, for the ceiling board 400, resins having high resistance against ink, such as polysulphon, polyethersulphon, polyphenylene oxide and polypropylene, are employed. The ceiling board 400 and orifice plate 404 are molded together into one piece. On the other hand, in the example of the configuration shown in FIG. 5, the orifice plate part 404 may be made of the same resin material as the main part of the ceiling board 400, or made of other kinds of resin material, or it may be formed of a film of a metal material. The orifice plate 404 is manufactured separately from the main body of the ceiling board 400. It is then inserted into the mold, and is integrally molded to the main body.

The method of forming the ink passage grooves 411, 412, and the orifices 421, 422 will be explained below.

For the ink passage grooves, resin is molded by cutting fine grooves of a reverse pattern. Using this, the ink passage grooves 411, 412 can be formed in the ceiling board 400.

The orifices 421, 422 can be formed by placing tops having the shape of the orifice, for example, cylindrical slide tops, in the portion of the metal mold where the orifices are to be located, by filling the mold with resin, and then removing the tops after the resin has hardened.

Another method may also be employed. Molding is carried out in a metal mold without having the orifices 421, 422. The moldings are then removed from the mold starting with the end surface side to the position at which they are to be formed. Then, for example, the moldings are irradiated with ultraviolet rays using a laser equipment, and the resin is removed or evaporated, forming the orifices 421, 422. Recessed parts for forming the ink passage grooves 411, 412 and the common liquid room 430 can also be formed by the irradiation of ultraviolet rays from a laser equipment. At this time, proper use of an excimer laser enables accurate machining along a mask pattern to be performed easily.

In the embodiment, the ceiling board 400 shown in FIGS. 4 and 5, whose width of the ink passage groove is 30 to 50 μm, whose width of the sections between the grooves is 20 to 40 μm, and whose diameter of the orifice hole is 20 to 40 μm, was obtained.

Figure 6:
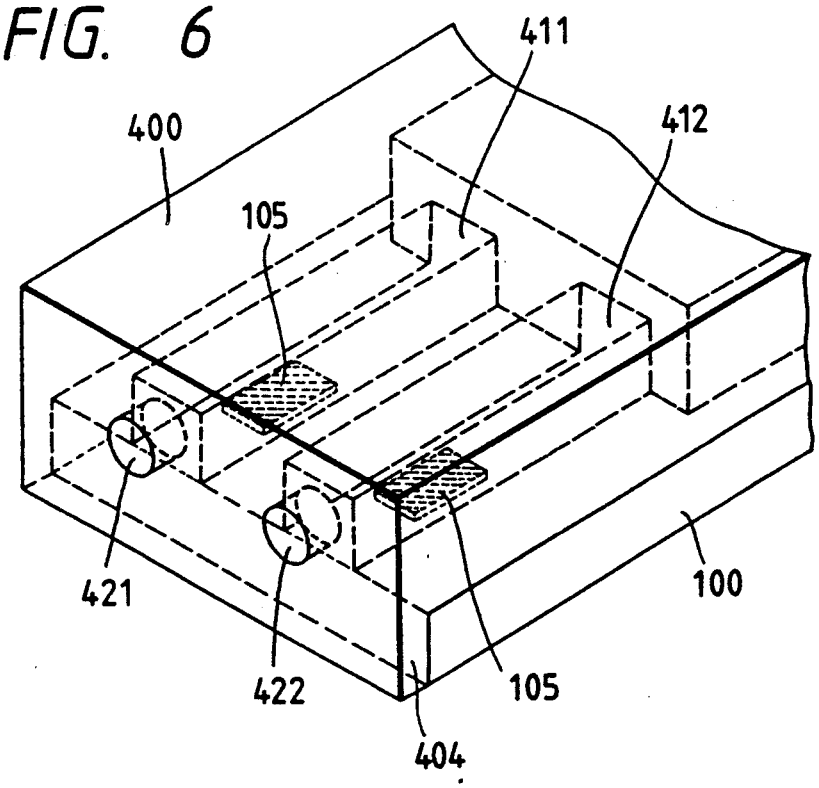
FIG. 6 is a perspective outlook view of a recording head body made from the respective parts shown in FIGS. 3 and 4 by joining.
Figure 7:
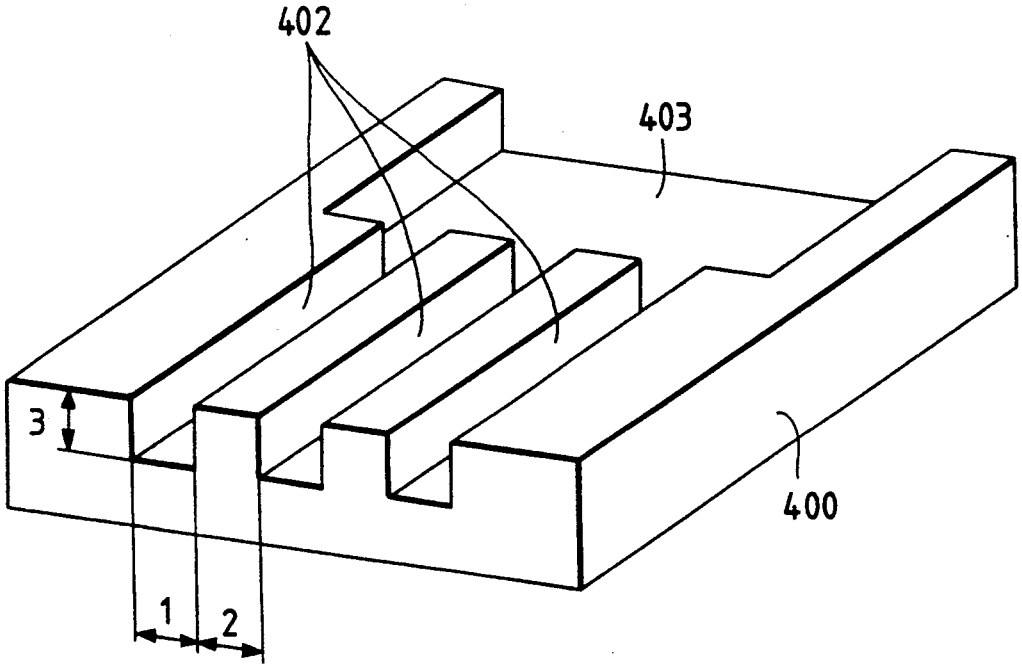
FIG. 7 is a perspective view illustrating a top plate formed by injection molding according to one embodiment of the present invention.
Figure 8:
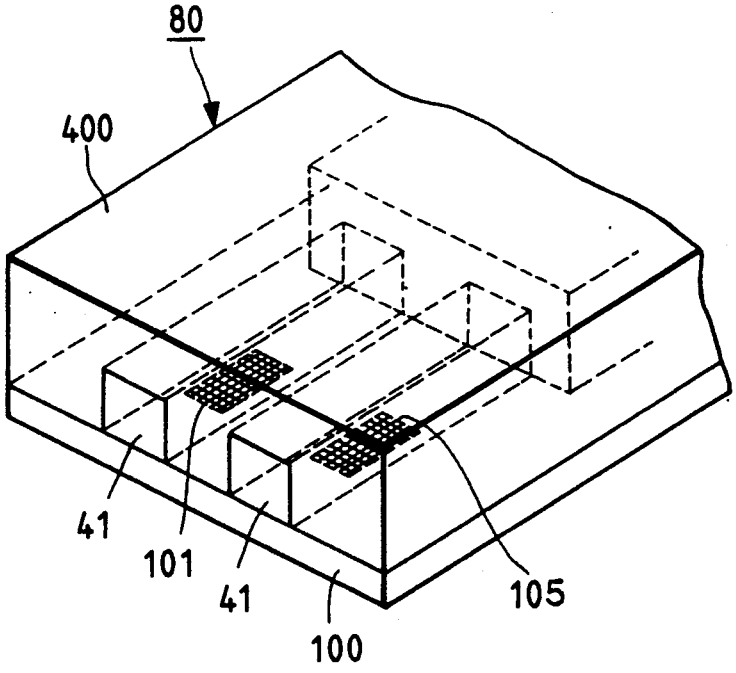
FIG. 8 is a perspective view of an ink jet recording head body comprising the top plate of FIG. 7.

As shown in FIG. 6, the end of the heater board 100 having the discharge heater 105 is brought into abutment with and joined to the orifice plate part 404, and a recording head main body is achieved.

In the configuration as described above, alignment and jointing of the ceiling board 400 to the orifice plate 404, unlike the prior art, is not required. So no alignment errors or positional deviations occur at joining time. Reduction of defective products and shortened manufacturing processes aids in the mass production of recording heads and in lowering prices. Since, unlike the prior art, no process of joining the ceiling board and the orifice plate is required, the possibility that the orifices and the ink passage will become blocked by the adhesive is also reduced. Further, since the heater board 100 and the orifice plate 404 at the time of joining with the ceiling board 400 are formed in one piece, positioning in the direction of the passage can be determined by placing the heater board 100 in abutment with the end surface of the discharge side of the orifice plate part 404 and the surface of the reverse side, and therefore the overall positioning process and assembling process become easy. In addition, no possibility of the separation of the orifice plate, as in the prior art, exists.

Figure 9:
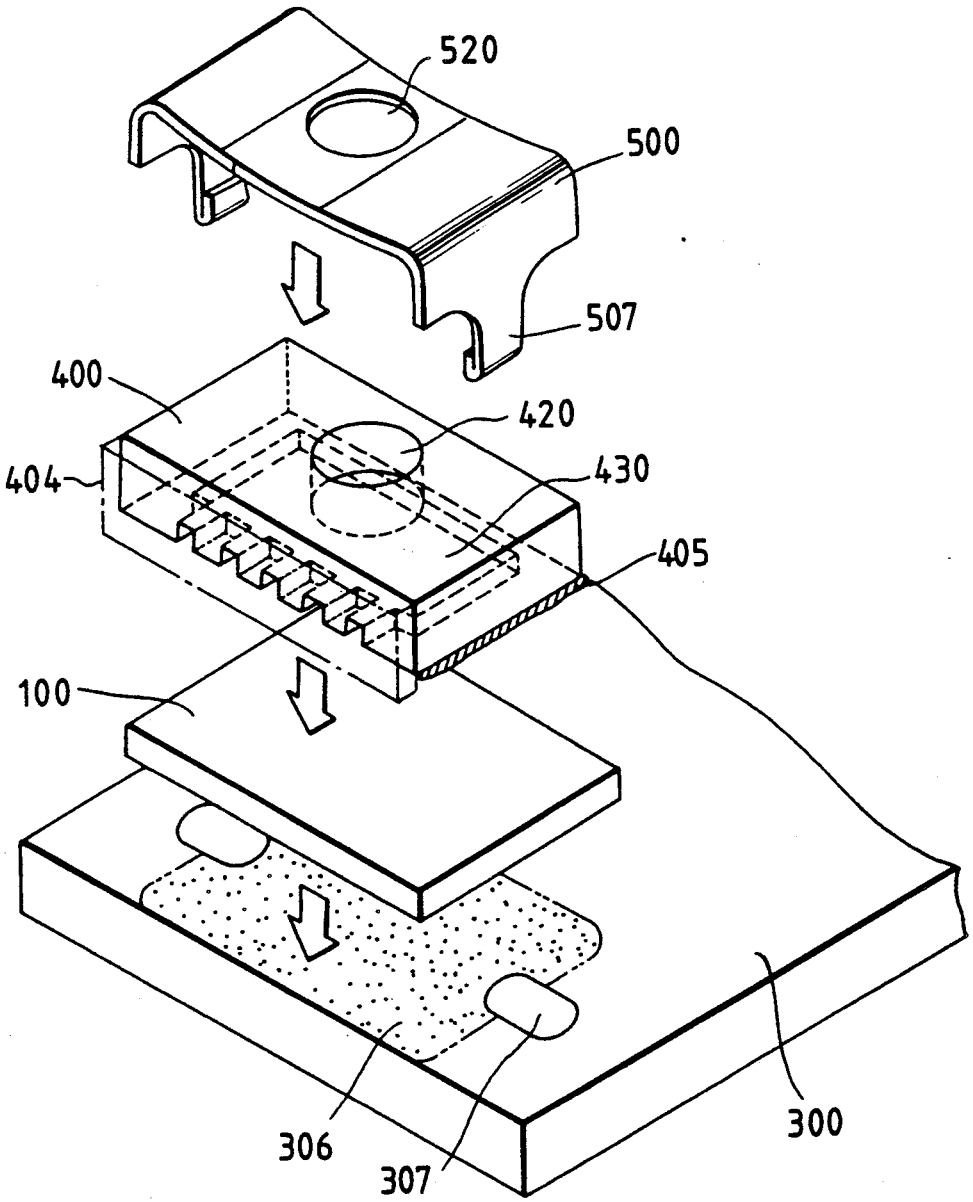
FIGS. 9 and 10 are views illustrating two examples of joining or assembling mode of a recording head body.

FIG. 9 shows one mode in which the heater board 100 and the ceiling board 400 is jointed and fixed. In the Figure, for simplification, the orifice plate 404 is indicated by dash-and-dot line, and the wiring pattern on the heater board 200 is not shown.

As described above, positioning of the heater board 100 and the ceiling board 400 is performed with the end surface of the heater board 100 in abutment with the orifice plate part 404. When these were joined, an adhesive agent 405 was applied to the three sides of the periphery of the ceiling board 400. This prevents the adhesive agent from flowing into the ink passage. Further, the adhesive agent may exist on the joining surface between the heater board 100 and the orifice plate 404, as much as needed and enough, over a proper range.

In the present embodiment, for this adhesive agent 405, the adhesive agent of the photohardening type, UV-201 (Grace Japan Co.) was used. After the positioning, for example, ultraviolet rays of 10 to 30 J/cm$^2$ were irradiated to harden and fix them. The portion where the adhesive agent 405 exists, is separated from the passage and the discharge outlet, so the allowable value for the number of tries in positioning increases.

Next, the recording head main body thus obtained by making the ceiling board 400 and the heater board 100 one-piece, is fixed on the support body 300 using an adhesive agent 306. For this adhesive agent 306, for example, HP2R/2H made by Canon Chemical Co. can be used.

In this condition, as described above, both boards (heater board 100 and ceiling board 400) are jointed only on the periphery other than the passage part, so are not sufficiently adhered. For this reason, the biasing force of the pressing spring is applied from the upper side of the ceiling board 400. For this pressing spring 500, for example, phosphor bronze or stainless for springs can be used to form it. A claw 507 provided in the lower part of both ends is fitted into the hole part 307 provided on the support body 300. The engagement of the two causes a mechanical pressure to apply from the upper part of the ceiling board 400. From this, both bodies become in strong contact. In this pressing spring 500, 520 is a hole, is through which passes the supply pipe connecting the ink inlet 420 of the ceiling board 400 and the ink supply inlet on the supply tank side.

In the present embodiment, when joining the ceiling board 400 and the heater board 100, an adhesive agent of photohardening type was used. However, any means can be used. If sufficient strength of fixation and contact can be obtained using the pressing spring 500, an adhesive agent is not necessarily required. For example, for the purpose of increasing the degree of sealing of a liquid, a proper sealing material, that is, sealing material such as a sealing agent or rubber packings may be used. Similarly, if a sufficient strength of fixation for the head main body can be obtained by the engagement of the claw 507 of the pressing spring 500 with the hole part 307 of the support body 300, an adhesive agent 306 need not be used.

According to the present embodiment, a sufficient joining can be obtained without applying an adhesive agent onto the surface of the passage wall of the ceiling board 400, so the process of applying an adhesive agent can be simplified. There was the possibility in the past that when deviations occurred in positioning, an adhesive agent was adhered onto the discharge hole 105 of the heater board 100, or the passage and the discharge outlet were clogged, so defective products were produced. There are no such cases in the present embodiment, enabling positioning to be performed for any number of times. Furthermore, some deformation and warp in the ceiling board for which resin material is used, and variations in manufacture are allowed, thus simplifying its manufacturing process.

Figure 10:
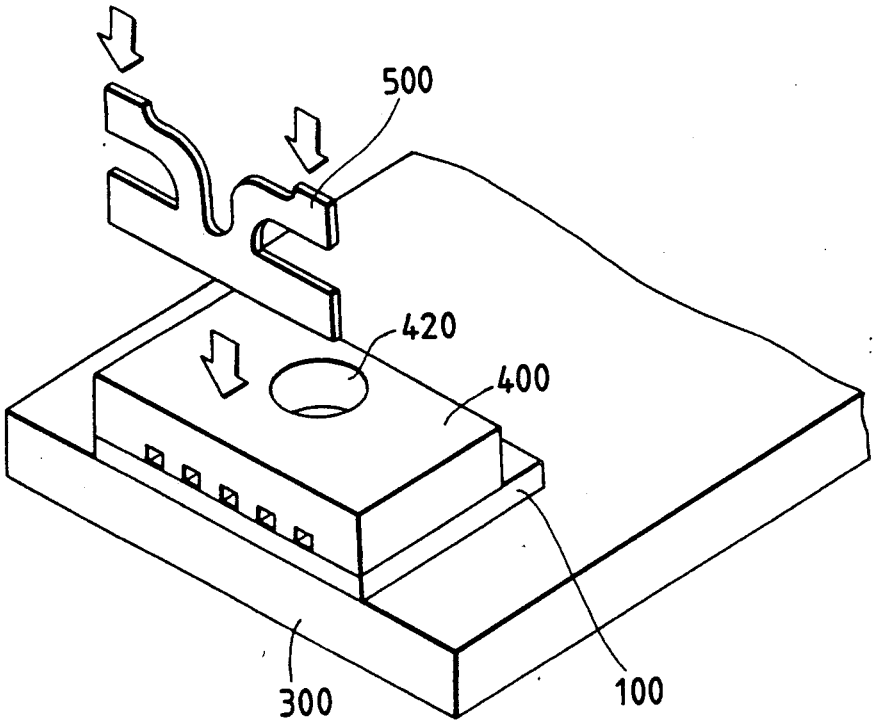

FIG. 10 shows an example of a variation of the configuration shown in FIG. 9. In the drawing, the orifice plate compartment 404 of the ceiling board 400 is not shown.

In the present embodiment, in the same way as for that shown in FIG. 9, it is structured so as to obtain sufficient contact by applying a pressure with a plate spring 500 made in the form of a plane from the upper surface of the ceiling board 400, under the condition that the support body 300 is jointed with the recording head main body consisting of the heater board 100 and the ceiling board 400. The plate spring 500 is furthermore pressed by another member (e.g., the supply tank 600 in FIGS. 2A and 2B) of the upper part.

From the present embodiment, the same effect as for the configuration shown in FIG. 6 was obtained.

Each part of the configuration as above is assembled in the process mentioned above for FIG. 2A, and thus the cartridge as shown in the same FIG. 2B can be obtained. By using this, an inkjet printer as shown in FIG. 11, that is, an inkjet printer using a disposable cartridge can be formed.

Figure 11:
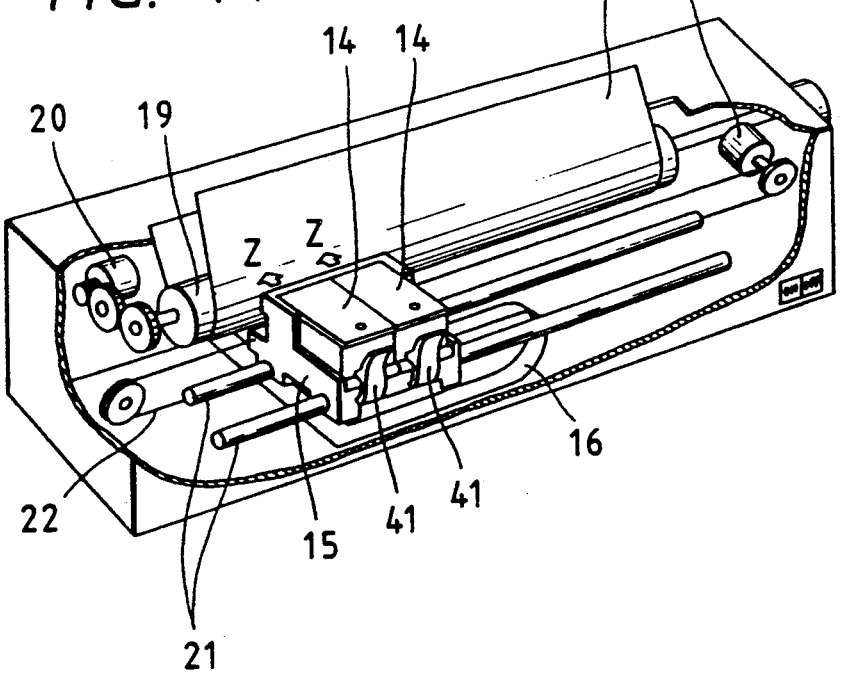
FIG. 11 is a perspective view illustrating one example of an ink jet printer comprising the cartridge of FIG. 2.

The reference character 14 in FIG. 11 is the cartridge shown in FIGS. 2A and 2B. This cartridge 14 is fixed onto the carriage 15 by a pressing member 41. These are movable back and forth transversely. The positioning of the carriage 15 can be performed, for example, by using a hole provided on the support body 300 and a dowel provided on the carriage 15 side. For electrical connection, the connector on the carriage 15 should be connected to the connection pad provided on the wiring board 200.

The ink discharged from the recording head reaches a recording medium 18 whose recording surface is controlled by the platen 19 at a very small interval with the recording head, and an image is formed on the recording medium 18.

A discharge signal dependent on the image data is supplied to the recording head via the cable 16 and the terminal connected to this. One or several (two in the Figure) of the cartridge 14 can be provided depending on the ink color used.

In FIG. 11, 17 is a carriage motor for scanning the carriage 15 along the shaft 21. 22 is a wire for transferring the driving force of the motor 17 to the carriage 15. 20 connected to the platen roller 19 is a feed motor for feeding the recording medium 18.

In such an inkjet printer using the disposable cartridge 14, when the ink impregnated in the absorber 900 runs short, the cartridge 14 is replaced. The cartridge 14 is desirably inexpensive. For the cartridge 14 described in the above embodiment, the manufacturing process is simple, and a small number of process steps is required. So it is constructed at a low cost and is most suited to convert it into a disposable type. Furthermore, positioning at the time when the recording head main body is assembled, can be performed accurately, and no fluctuations in dimension or clogging of the passage caused by an adhesive agent flowing into it does not occur, resulting in very high reliability and improved yield.

It goes without saying that the present invention is not limited to the embodiment described above, and various configuration may be adopted.

For example, in the above embodiment, the recording head main body and the ink supply source are integrated into one piece and are made disposable. They may be separate from each other, and may not necessarily each be disposable. In other words, if the recording head main body is a fixed type, and a simple replacement is not premised, constructing this head with ease and at a low cost aids in making the printer main body inexpensive.

For the recording head main body consisting of the heater board 100 and the ceiling board 400, in the above embodiment, a recessed part for the ink passage and a common liquid compartment is provided only on the ceiling board side, but this may be provided on both sides.

In the above embodiment, this recording head main body is made to use a discharge heater 105 to convert the heat energy to a discharge energy. However, a configuration in which an electro-mechanical conversion element in accordance with an electrical connection is used to convert its mechanical vibration into an discharge energy, may be employed.

Furthermore, in the above embodiment, the orifice plate compartment 404 itself is configured to include the abutment part of the heater board, but the shape of the abutment part may take any form. For example, such an abutment part may be provided in the direction of the side so as to perform transverse positioning. Or instead of providing such an abutment part, positioning may be performed by a combination of dowels and holes. If the positioning does not pose a problem, an abutment member and a positioning member are not needed. That is, the ceiling board may take the configuration in which it has a wall part on a plane with the jointing surface in the forward of the grooves, and a discharge outlet is formed therein.

We claim:

1. A liquid jet recording head comprising;

a first substrate provided with a plurality of energy-generating elements that generate energy for discharging a recording liquid;

a second substrate joined to said first substrate, said second substrate having a plurality of grooves that form passages for said recording liquid, each groove corresponding to one energy-generating element, said second substrate being integral with a discharge port-forming member, said discharge port-forming member forming discharge ports for said recording liquid at a discharge end of the grooves, each port corresponding to one groove; and a biasing member for joining said first and second substrates to each other by a mechanically biasing force, said biasing member being arranged so that a force applying portion of said biasing member is substantially disposed along a direction in which the discharge ports are arranged.

2. A liquid jet recording head according to claim 1, wherein said discharge port-forming member has a form of a planar member for positioning said first substrate by abutment.

3. A liquid jet recording head according to claim 1 or 2, wherein said discharge port-forming member is integral with said second substrate by simultaneous molding of a same resin material.

4. A liquid jet recording head according to claim 1 or 2, wherein said discharge port-forming member is integral with said second substrate by insert molding after said second substrate is molded from a resin material.

5. A liquid jet recording head according to claim 1, wherein an adhesive is provided only on the peripheral sides on a plurality of joining surfaces of said first and second substrates excluding the joining surface on which the discharge ports are located.

6. A liquid jet recording head according to claim 1, wherein a sealing agent is provided only on the peripheral sides on a plurality of joining surfaces of said first and second substrates excluding the joining surface on which the discharge ports are located.

7. A liquid jet recording head according to claim 5 or 6, wherein said first substrate is provided on a support, said support and said biasing member having an engagement part capable of engaging said support with said biasing member, and said biasing member having a spring member for providing a pressing force from the backside of said second substrate by the engagement.

8. A liquid jet recording head according to any one of claims 1, 2, 5, or 6, wherein said energy-generating element has a form of electro-thermal converter that generates thermal energy for discharging said recording liquid.

9. A liquid jet recording head according to claim 1, wherein said biasing member has a spring member having an M-shaped cross-section.

10. A liquid jet recording head according to claim 1, wherein said biasing member has a spring member linearly pressing an area of passages.

11. A liquid jet recording head according to claim 1, wherein the grooves are provided on said second substrate to form a plurality of passages and a common liquid chamber for storing said recording liquid to be supplied to said plurality of the passages and said second substrate is integrally formed by injection molding.

12. A liquid jet recording head comprising:

a first substrate and a second substrate, said first and second substrates being joined to form passages for a recording liquid;

a plurality of energy generating elements provided on one of said first and second substrates;

discharge ports communicating with each of the passages;

and a force-endowing member providing a force to said first and second substrates, thereby joining said first and second substrates, said force-endowing member being arranged so that a force applying portion of said force-endowing member is substantially disposed along a direction in which the discharge prots are arranged.

13. A liquid jet recording head according to claim 12, wherein an adhesive is provided only on the peripheral sides on a plurality of joining surfaces of said first and second substrates excluding the joining surface on which the discharge ports are located.

14. A liquid jet recording head according to claim 12, wherein a sealing agent is provided only on the peripheral sides on a plurality of joining surfaces of said first and second substrates excluding the joining surface the side on which the discharge ports are located.

15. A liquid jet recording head according to claim 12 or 14, wherein one of said first and second substrates is provided on a support, said support and said force-endowing member having an engagement part capable of engaging said support with said force-endowing member, and said force-endowing member having a spring member for providing a pressing force from the backside of the other substrate by the engagement.

16. A liquid jet recording head according to any one of claims 12, 13 or 14, wherein said plurality of energy-generating elements are electro-thermal converters for generating energy for discharging said recording liquid.

17. A liquid jet recording head according to claim 12, wherein said force-endowing member is a spring member having an M-shaped cross-section.

18. A liquid jet recording head according to claim 12, wherein said force-endowing member is a spring member linearly pressing the area of said passages.

19. A liquid jet recording head comprising:

a first substrate provided with an energy-generating element for generating an energy for discharging a recording liquid; and a second substrate joined to said first substrate, said second substrate having grooves that form passages for said recording liquid at the joining and being integral with a discharge port-forming member that forms discharge ports at a discharge end of the grooves, wherein said discharge port-forming member is in the form of a planar member for positioning said first substrate by abutment.

20. A liquid jet recording head according to claim 19, wherein said discharge port-forming member is integrated with said second substrate by simultaneous molding of a same resin material.

21. A liquid jet recording head according to claim 19, wherein said discharge port-forming member is integrated with said second substrate by insert molding after said second substrate is molded from a resin material.

22. A liquid jet recording head according to any one of claims 19, 20 or 21, wherein said energy-generating element is an electro-thermal converter that generates thermal energy for discharging said recording liquid.

23. A liquid jet recording head according to claim 19, wherein the grooves are provided on said second substrate to form a plurality of passages and a common liquid chamber for storing said recording liquid to be supplied to said plurality of passages and said second substrate is integrally formed by injection molding.

24. A liquid jet recording head according to one of claims 1, 12 or 19, wherein said second substrate includes a recess forming a common liquid chamber for storing said recording liquid to be supplied to said passages.

25. A liquid jet recording head according to claim 24, wherein each energy-generating element is an electro-thermal converter element that generates a thermal energy for discharging said recording liquid.

26. A liquid jet recording head according to claim 24, wherein said second substrate is made of a resin.

27. A liquid jet recording head according to claim 25, wherein said second substrate is made of a resin.

28. An ink jet recording apparatus comprising:

a recording head having a first substrate provided with a plurality of energy-generating elements that generate energy for discharging a recording liquid;

a second substrate joined to said first substrate, said second substrate having a plurality of grooves that form passages for said recording liquid, each groove corresponding to one energy-generating element, said second substrate being integral with a discharge port-forming member, said discharge port-forming member forming discharge ports for said recording liquid at a discharge end of the grooves, each port corresponding to one groove;

a biasing member for joining said first and second substrates to each other by a mechanically biasing force, said biasing member being arranged so that a force applying portion of said biasing member is substantially disposed along a direction in which the discharge ports are arranged; and conveying means for conveying a recording medium to be recorded by said recording liquid discharged from said recording head.

29. An ink jet recording apparatus comprising:

a recording head having a first substrate and a second substrate, said first and second substrates being joined to form passages for a recording liquid;

a plurality of energy generating elements provided on one of said first and second substrates;

discharge ports communicating with each of the passages;

a force-endowing member providing a force to said first and second substrates, thereby joining said first and second substrates, said force-endowing member being arranged so that a force applying portion of said force-endowing member is substantially disposed along a direction in which the discharge ports are arranged; and conveying means for conveying a recording medium to be recorded by said recording liquid discharged from said recording head.

30. An ink jet recording apparatus comprising:

a recording head having a first substrate provided with an energy-generating element for generating an energy for discharging a recording liquid;

a second substrate joined to said first substrate, said second substrate having grooves that form passages for said recording liquid at the joining and being integral with a discharge port-forming member that forms discharge ports at a discharge end of the grooves, wherein said discharge port-forming member is in the form of a planar member for positioning said first substrate by abutment; and conveying means for conveying a recording medium to be recorded by said recording liquid discharged from said recording head.

* * * * *

UNITED STATES PATENT AND TRADEMARK OFFICE

CERTIFICATE OF CORRECTION

PATENT NO. : 5,095,321

DATED : March 10, 1992

INVENTOR(S) : AKIO SAITO, ET AL.

It is certified that error appears in the above-identified patent and that said Letters Patent is hereby corrected as shown below:

COLUMN 2

Line 10, "jointing" should read --joining--.
Line 36, "jointing" should read --joining-- (both occurrences).
Line 41, "jointing" should read --joining--.

COLUMN 3

Line 19, "throughly" should read --thoroughly--.
Line 53, "whose" should be deleted.

COLUMN 4

Line 11, "fixing," should read --fixing--.

COLUMN 5

Line 24, "a" should be deleted.
Line 29, "FIG." should read --FIGS.--.
Line 30, "FIG." should read --FIGS.--.
Line 37, "FIG." should read --FIGS.--.

COLUMN 6

Line 30, "heat" should read --heater--.

COLUMN 7

Line 56, "aids" should read --aid--.

UNITED STATES PATENT AND TRADEMARK OFFICE

CERTIFICATE OF CORRECTION

PATENT NO. : 5,095,321

DATED : March 10, 1992

INVENTOR(S) : AKIO SAITO, ET AL.

It is certified that error appears in the above-identified patent and that said Letters Patent is hereby corrected as shown below:

COLUMN 8

Line 4, "is jointed" should read --are joined--.
Line 7, "board 200" should read --board 100--.
Line 28, "one-piece," should read --one piece,--.
Line 38, "stainless" should read --stainless steel--.
Line 45, "500, 520 is a hole, is" should read --500 is a hole 520,--.

COLUMN 9

Line 24, "FIG. 6" should read --FIG. 9--.

COLUMN 10

Line 3, "configuration" should read --configurations--.

COLUMN 11

Line 53, "prots" should read --ports--.

Signed and Sealed this

Eighth Day of June, 1993

*Attest:*

Michael K. Kirk

MICHAEL K. KIRK

*Attesting Officer*

*Acting Commissioner of Patents and Trademarks*